US012760487B2

(12) United States Patent
Mikhelson et al.

(10) Patent No.: US 12,760,487 B2
(45) **Date of Patent: *Oct. 13, 2026**

(54) GRAVITY-BASED STRUCTURE (GBS)

(71) Applicant: Publichnoe Aktsionernoe Obshchestvo "NOVATEK", Tarko-Sale (RU)

(72) Inventors: Leonid Viktorovich Mikhelson, Moscow (RU); Valeriy Nikolaevich Retivov, Moscow (RU); Sergey Gennadyevich Solovyev, Novyy Urengoy (RU)

(73) Assignee: Publichnoe Aktsionernoe Obschchestvo "NOVATEK", Tarko-Sale (RU)

( * ) Notice: Subject to any disclaimer, the term of this patent is extended or adjusted under 35 U.S.C. 154(b) by 224 days.

This patent is subject to a terminal disclaimer.

(21) Appl. No.: 18/715,851

(22) PCT Filed: Oct. 10, 2022

(86) PCT No.: PCT/RU2022/000310
§ 371 (c)(1),
(2) Date: Jun. 3, 2024

(87) PCT Pub. No.: WO2023/113640
PCT Pub. Date: Jun. 22, 2023

(65) Prior Publication Data

US 2025/0171115 A1 May 29, 2025

(30) Foreign Application Priority Data

Dec. 15, 2021 (RU) ..... RU2021137146

(51) Int. Cl.
*E02D 15/08* (2006.01)
*B63B 77/00* (2020.01)
(Continued)

(52) U.S. Cl.
CPC ..... *E02D 15/08* (2013.01); *E02B 17/02* (2013.01); *E02B 17/025* (2013.01); *E21B 41/0007* (2013.01); *B63B 77/00* (2020.01)

(58) Field of Classification Search
CPC ..... E02B 17/02; E02B 17/025; E02D 15/08; E21B 41/0007
See application file for complete search history.

(56) References Cited

U.S. PATENT DOCUMENTS 3,412,564 A * 11/1968 Mcclintock ..... E02B 17/02 405/208
3,766,583 A * 10/1973 Phelps ..... F25J 1/004 405/203
(Continued)

FOREIGN PATENT DOCUMENTS

FR 2894646 A1 * 6/2007 ..... F17C 13/082
GB 1344938 A 1/1974
(Continued)

OTHER PUBLICATIONS

FR-2894646-A1 machine translation (Year: 2007).*
(Continued)

*Primary Examiner* — Matthew Wiblin
(74) *Attorney, Agent, or Firm* — Collard & Roe, P.C.

(57) ABSTRACT

A gravity-based structure for hydrotechnical facilities and for setting up production, transport, transshipment and warehouse complexes with applications near-shore and offshore. The GBS has rectangular top and base slabs, external walls and internal vertical walls to separate the compartments, a central part forming a rectangular prism with the top slab, and a protruding part stretching along the central part sides around its perimeter and having vertical external walls. The protruding and central parts share the base slab, with the protruding part being shorter than the central part. Central part internal vertical longitudinal and transverse walls form
(Continued)

Figure 1:
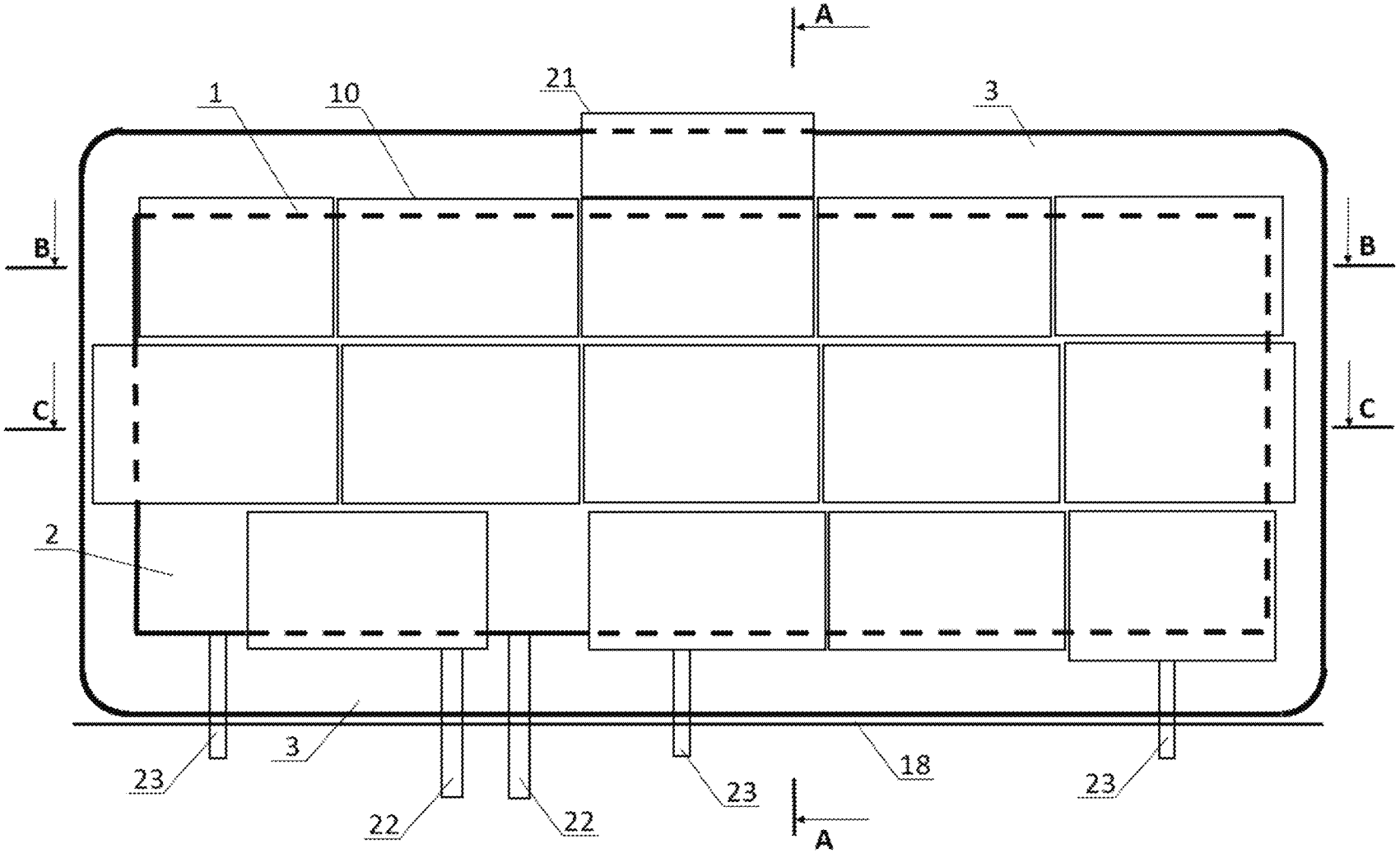

compartments. Protruding part internal vertical walls perpendicular to external walls form compartments from the short ends and ballast compartments on the sides. Vertical longitudinal and transverse walls form additional compartments between the intermediate horizontal and base slabs. The design is suitable for shallow waters transportation and adjusted to Arctic conditions and ice impact.

1 Claim, 8 Drawing Sheets

(51) Int. Cl.
*E02B 17/02* (2006.01)
*E21B 41/00* (2006.01)

(56) References Cited

U.S. PATENT DOCUMENTS

| | | | | | |
|---|---|---|---|---|---|
| 3,793,840 | A * | 2/1974 | Mott | E02D 27/425 405/211 |
| 3,886,753 | A * | 6/1975 | Birdy | E02B 17/025 405/207 |
| 4,486,125 | A * | 12/1984 | Reusswig | E02B 17/0021 405/203 |
| 4,497,594 | A * | 2/1985 | Fern | E02B 17/02 405/203 |
| 4,618,286 | A * | 10/1986 | Michel | E02B 17/0021 405/208 |
| 4,778,308 | A * | 10/1988 | Stove | E02B 17/025 405/203 |
| 2016/0326706 | A1* | 11/2016 | Cheung | E02B 17/0021 |
| 2022/0324541 | A1 | 10/2022 | Kanayama et al. | |

FOREIGN PATENT DOCUMENTS

| | | | |
|---|---|---|---|
| JP | S58-101915 | A | 6/1983 |
| KR | 10-2015-0023161 | A | 3/2015 |
| KR | 20150136823 | A | 12/2015 |
| KR | 10-2018-0051852 | A | 5/2018 |
| RU | 2 467 122 | C1 | 11/2012 |
| WO | 2021/106151 | A1 | 6/2021 |

OTHER PUBLICATIONS

International Search Report in PCT/RU2022/000312, mailed Mar. 2, 2023.

Tistel Joar et al, "Gravity Based Structure Foundation Design and Optimization Opportunities", Proceedings of the Twenty-fifth (2015) International Ocean and Polar Engineering Conference, Kana, Big Island, Hawaii, USA, Jun. 21-26, 2015 [online]. Retrieved from <https://www.researchgate.net/publication/282605135_Gravity-Based Structure Foundation Design and Optimization Opportunities>, total of 9 pages.

Widianto et al., "Concrete Gravity-Based Structure, Construction of the Hebron offshore oil platform", [online] Jun. 2016, V. 38, No. 6, Retrieved from <https://www.concrete.Org/Portals/O/Files/PDF/hebron_platform_sl9.pdf>, total of 9 pages.

International Search Report in PCT/RU2022/000310, mailed Feb. 9, 2023.

Gyetvay Mark, CFO and Deputy Chairman of the Management Board and Alexander Nazarov, Head of Investor Relations, "A Major New Player: Expanding Our Global LNG Footprint From 2018 to 2030", Sberbank CIB—"Russia: The Inside Track" Conference Moscow, May 22-23, 2018 [online] [retrieved on Dec. 22, 2022]. Retrieved from <https://www.novatek.ru/common/upload/doc/IR_May_2018_.pdf>, p. 13-16, total of 36 pages.

Waters Lisa B. et al., Design and Construction on Gravity Based Structure and Modularized LNG Tanks for the Adriatic LNG Terminal. ExxonMobil Development Company, 2007, [online] [retrieved on Dec. 22, 2022]. Retrieved from <http://www.ivt.ntnu.no/ept/fag/tep4215/innhold/LNG%20Conferences/2007/fscommand/PS6_7 _Waters_s.pdf>, total of 29 pages.

Unlocking Our Arctic Resources: Decarbonizing Our Footprint. Think Green. Think Natural Gas. Energy Affordability, Security & Sustainability Investor Meeting, May 2021, [online] [retrieved on Dec. 22, 2022]. Retrieved from <https://www.novatek.ru/common/upload/doc/IR_May_2021_Investor_Meetings_updated.pdf>, total of 50 pages.

* cited by examiner

GRAVITY-BASED STRUCTURE (GBS)

CROSS REFERENCE TO RELATED APPLICATIONS

This application is the National Stage of PCT/RU2022/000310 filed on Oct. 10, 2022, which claims priority under 35 U.S.C. § 119 of Russian Application No. 2021137146 filed on Dec. 15, 2021, the disclosure of which is incorporated by reference. The international application under PCT article 21(2) was not published in English.

TECHNICAL FIELD

The invention is applicable to hydrotechnical facilities and can be used for setting up production, transport, transshipment and warehouse complexes with various applications in near-shore and offshore locations.

BACKGROUND ART

A gravity-based structure (GBS, a fixed gravity-based offshore platform) is a platform, which is fixed on a seabed with the help of its own weight. Gravity-based structures are used in waters near the shore and off the shore, including in ice conditions, where water depths are sufficient to support a superstructure of required height above water level once a GBS is installed on the seabed. A GBS is made of reinforced concrete and could be used as foundation for raw hydrocarbons production, storage, processing and transshipment equipment. Gravity-based structures can feature internal compartments to enable their floatability during transportation to their installation sites. GBS are designed to be floatable and have ballasting systems to enable long-distance transportation and installation for operation at the intended offshore site without using expensive lifting and transportation equipment.

There exists a gravity-based structure for an offshore LNG production, storage and offloading structure (KR 20180051852 A, publication date: 17.05.2018). The GBS is made of steel and is installed on a preprepared underbase foundation on a seabed near the shore with the help of solid ballasting. LNG process equipment is installed onto the GBS once it is installed on the seabed. The GBS comprises an outer steel caisson in the form of a box with its lower surface sitting on the foundation prepared on the seabed near the shore; an inner steel caisson in the form of a box with an LNG storage space, to be installed inside the outer caisson with the smallest possible clearance; a top deck mounted on the outer steel caisson; a wall made from a waterproof insulation plate mounted on internal surfaces of the inner steel caisson and the top deck to isolate liquefied gas; a liquefaction installation and an offloading installation located on the top deck; and a solid ballast filling the space between the outer and the inner caissons to ensure the structure stability on the seabed due to gravity.

This design features the following disadvantages.

1. The GBS steel body is more prone to corrosion, which makes it less durable.
2. The GBS steel body needs to be significantly thick to withstand ice impacts, meaning greater steel intensity.
3. The solid ballast makes GBS ballasting/de-ballasting more challenging.
4. The GBS is not protected from external effects such as ice impact or emergency ship impact.

5. Rectangular prism-shaped GBS has large draft when transported to the installation site, which makes transportation through shallow water areas impossible.

There is known an offshore natural gas processing facility on a gravity-based structure (GBS) (WO2021/106151 A1, publication date: 03.06.2021) comprising a rectangular prism-shaped GBS with a base slab and a top slab, internal vertical walls and an intermediate slab, on which one or more LNG tanks are located in one compartment, and also a ballast compartment stretching all along the GBS, and topside modules mounted on supports on the top slab.

Such GBS features the following disadvantages:

- rectangular prism-shaped GBS has large draft when transported to Ør installation site, which makes transportation through shallow water areas impossible;
- GBS ballasting becomes a challenge since there is a long ballasting compartment stretching all along the GBS without any transverse partitions;
- with LNG tanks arranged in a row in the same compartment, it is impossible to use membrane tanks that feature the lowest steel intensity;
- the GBS is not protected from external effects such as ice impact or emergency ship impact.

The solution which is closest to the proposed one is a gravity-based structure (GBS) being a prism-shaped box-type concrete structure which includes top and base slabs, external walls, internal longitudinal and transversal walls to separate compartments, and intermediate support slab for tanks (Design and Construction on Gravity Based Structure and Modularized LNG Tanks for the Adriatic LNG Terminal. Lisa B. Waters et al. ExxonMobil Development Company. 2007. http://www.ivt.ntnu.no/ept/fag/tep4215/innhold/LNG % 20Conferences/2007/f scommand/PS6_7_Waters_s.pdf (file PS6_7_Waters_s).

The disadvantages of this GBS are also that prism-shaped GBS has large draft during transportation to an installation site, making transportation through shallow water impossible, as well as the fact that the GBS is not protected from ice impact, and to provide protection from emergency berthing impact, berthing facilities have to be moved away from the GBS outer walls with truss structures.

SUMMARY OF THE INVENTION

The technical problem resolved with the invention is as follows. Taking into account the increasing share of production and infrastructure facilities in underdeveloped areas, including near-shore and offshore areas in the Arctic, there is a pressing need to develop a new design of a gravity-based structure suitable for transportation in shallow waters and adapted to operate in waters with ice conditions in the Arctic.

The proposed solution for the above problem is a gravity-based structure (GBS) that has a rectangular base slab and a rectangular top slab, external walls and internal vertical walls forming compartments, besides, in accordance with the invention, the GBS has a central part and a protruding part, with the central part being a rectangular prism with the said top slab, and the protruding part stretching along the central part sides all around its perimeter and having external vertical walls and internal vertical walls forming ballast compartments at the protruding part sides, and the protruding part and the central part share the said base slab, with the protruding part being lower in height than the central part.

A preferable design features the GBS central part with internal vertical longitudinal and transverse walls forming compartments, with protruding part internal vertical walls being perpendicular to its external walls and forming compartments.

One more preferable design also features an intermediate horizontal slab inside the GBS, with vertical longitudinal and transverse walls, which form additional compartments, between the intermediate horizontal slab and the base slab.

The technical result achieved by the proposed technical solution is as follows.

The GBS protruding part adds to buoyancy of the GBS and the entire structure, as well as reduces its draft during transportation to the installation site.

Additional ballast compartments in the peripheral part of the GBS inside the protruding part make it easy to balance the GBS, i.e. to settle the GBS down evenly, without roll and trim.

Increased width of the GBS bottom part adds to the stability of the entire structure during its transportation, enabling to install a topside structure of greater height and weight onto the GBS.

The GBS protruding part also protects the central part from ice impact and emergency ship impact.

The protruding part may also serve as a foundation for a jetty.

LIST OF DRAWINGS

FIG. 1 shows the integrated production complex on a GBS layout, top view.

Figure 2:
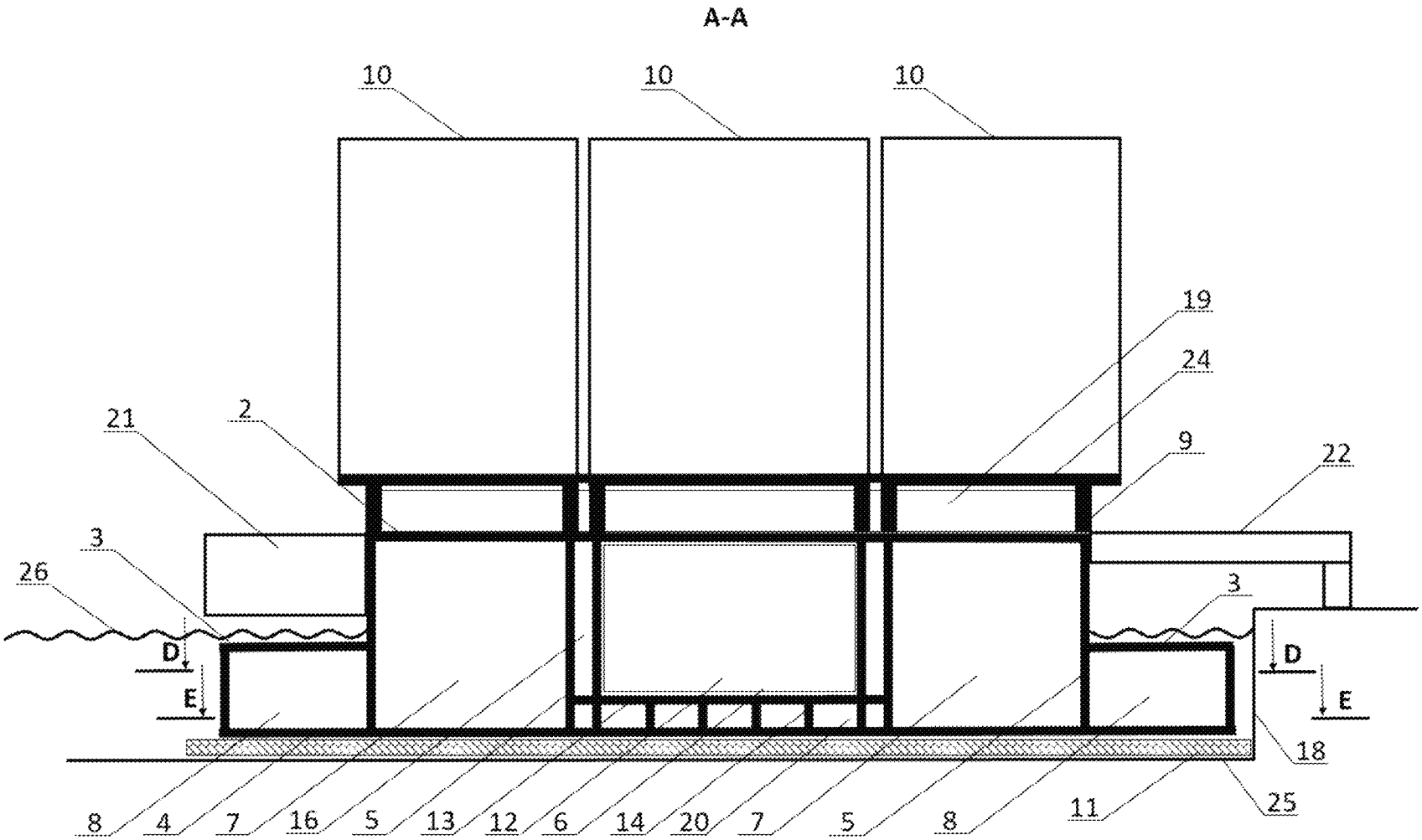

FIG. 2—transverse section A-A for FIG. 1.

Figure 3:
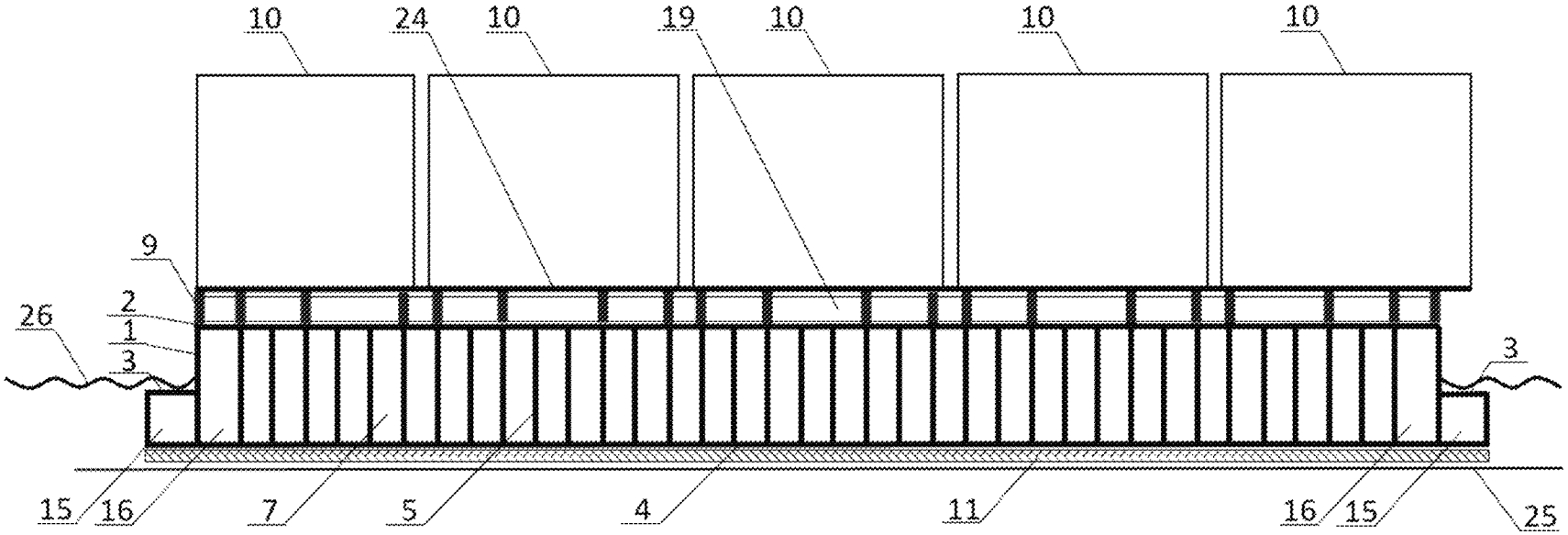

FIG. 3—longitudinal section B-B for FIG. 1.

Figure 4:
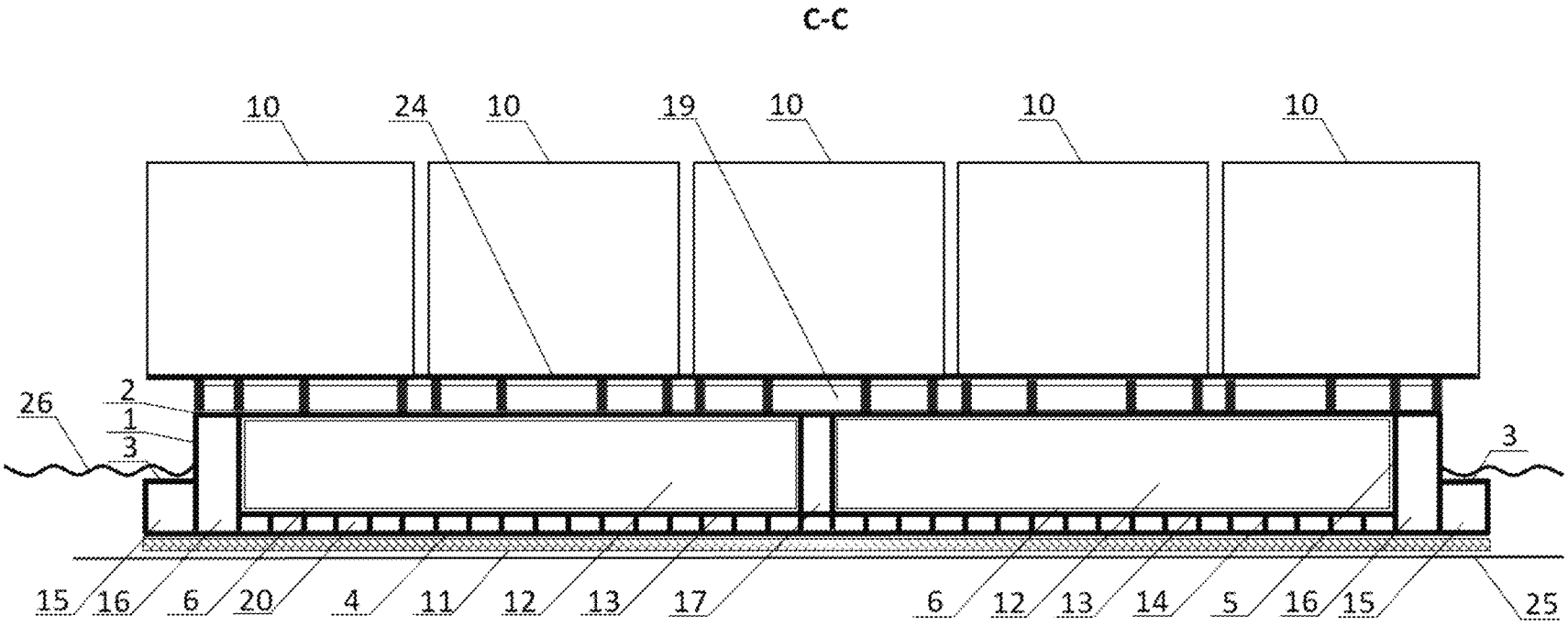

FIG. 4—longitudinal section C-C for FIG. 1.

Figure 5:
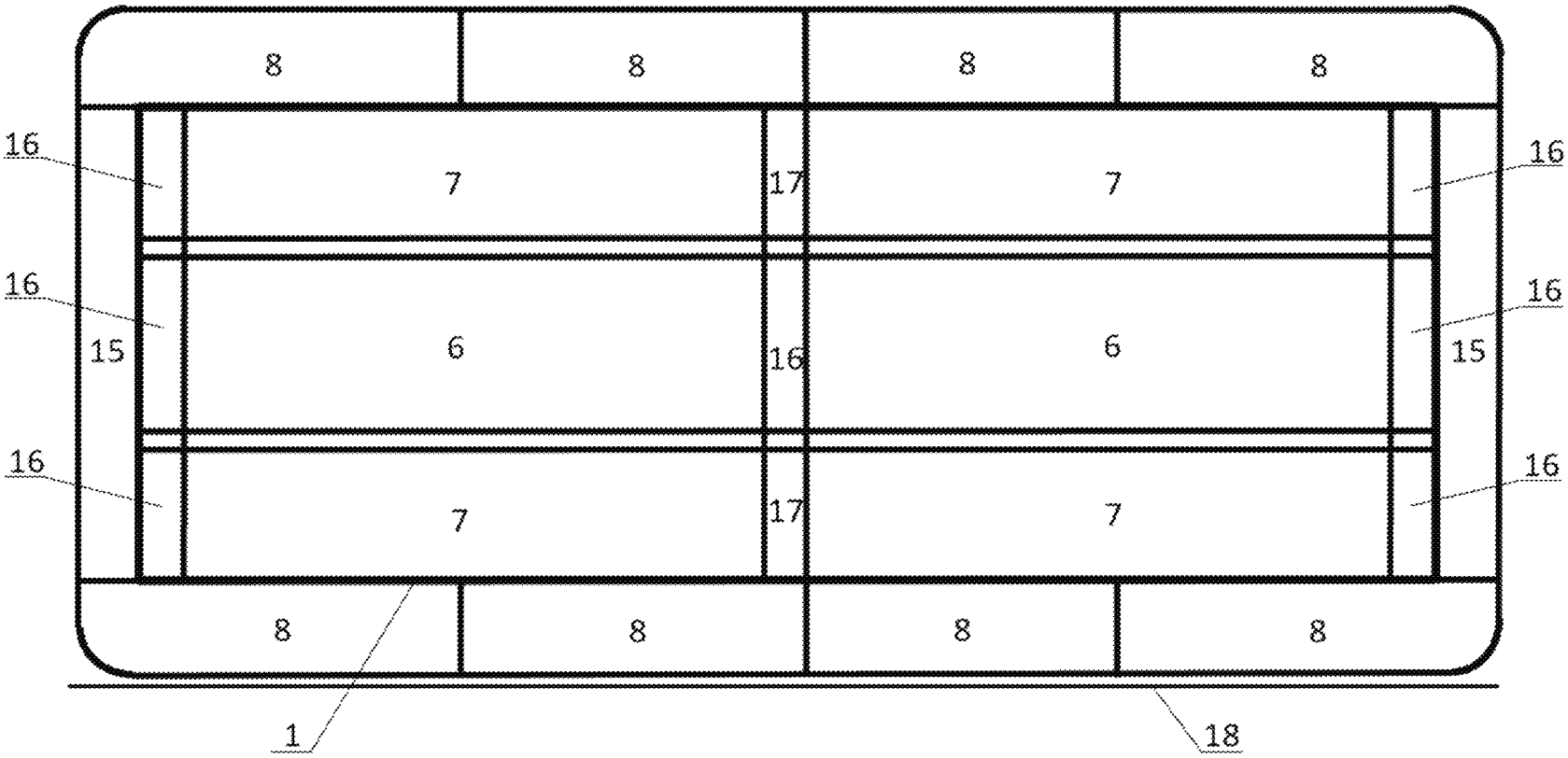

FIG. 5—layout of the GBS main compartments.

Figure 6:
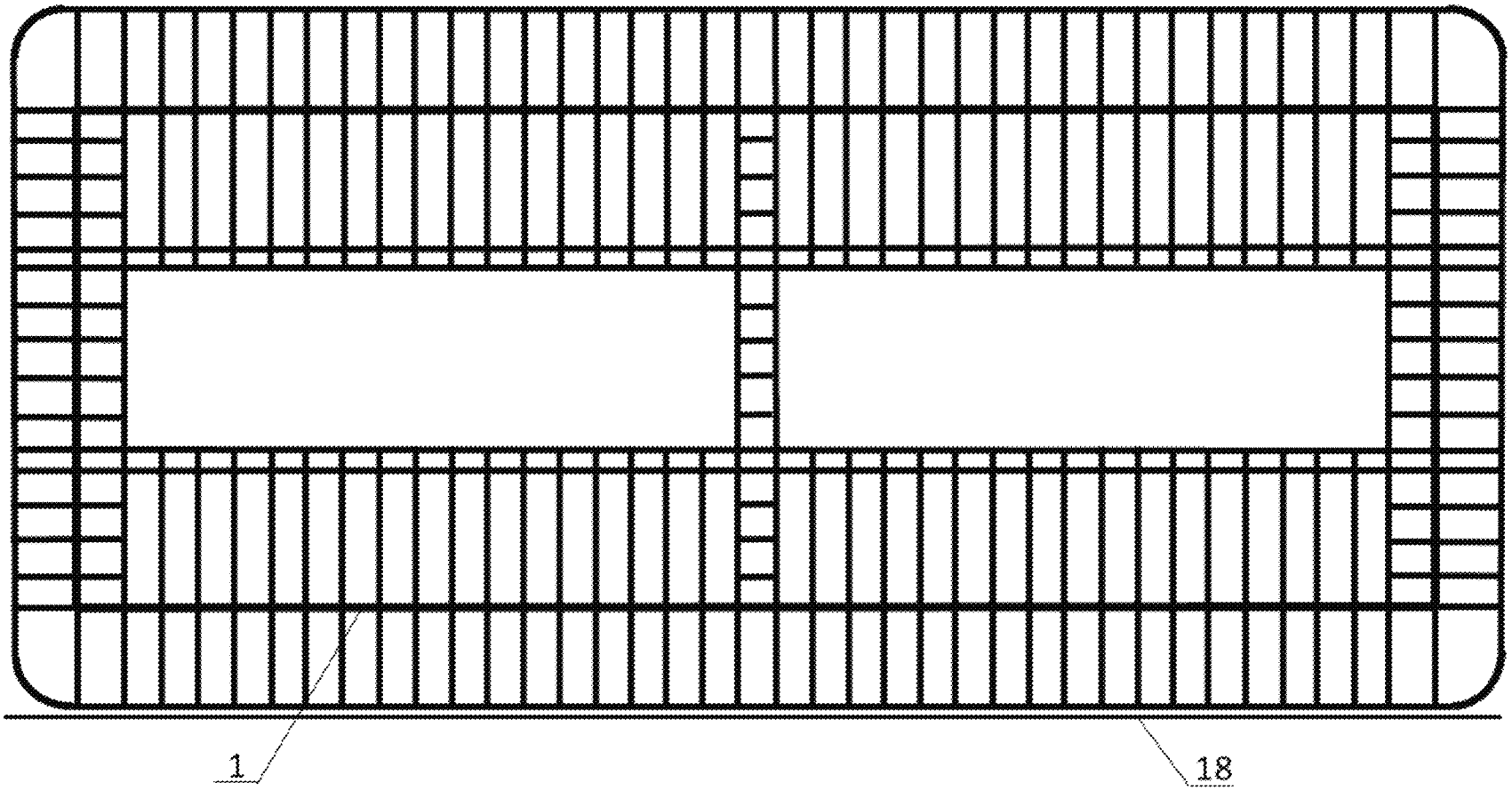

FIG. 6—vertical walls arrangement in section D-D for FIG. 2.

Figure 7:
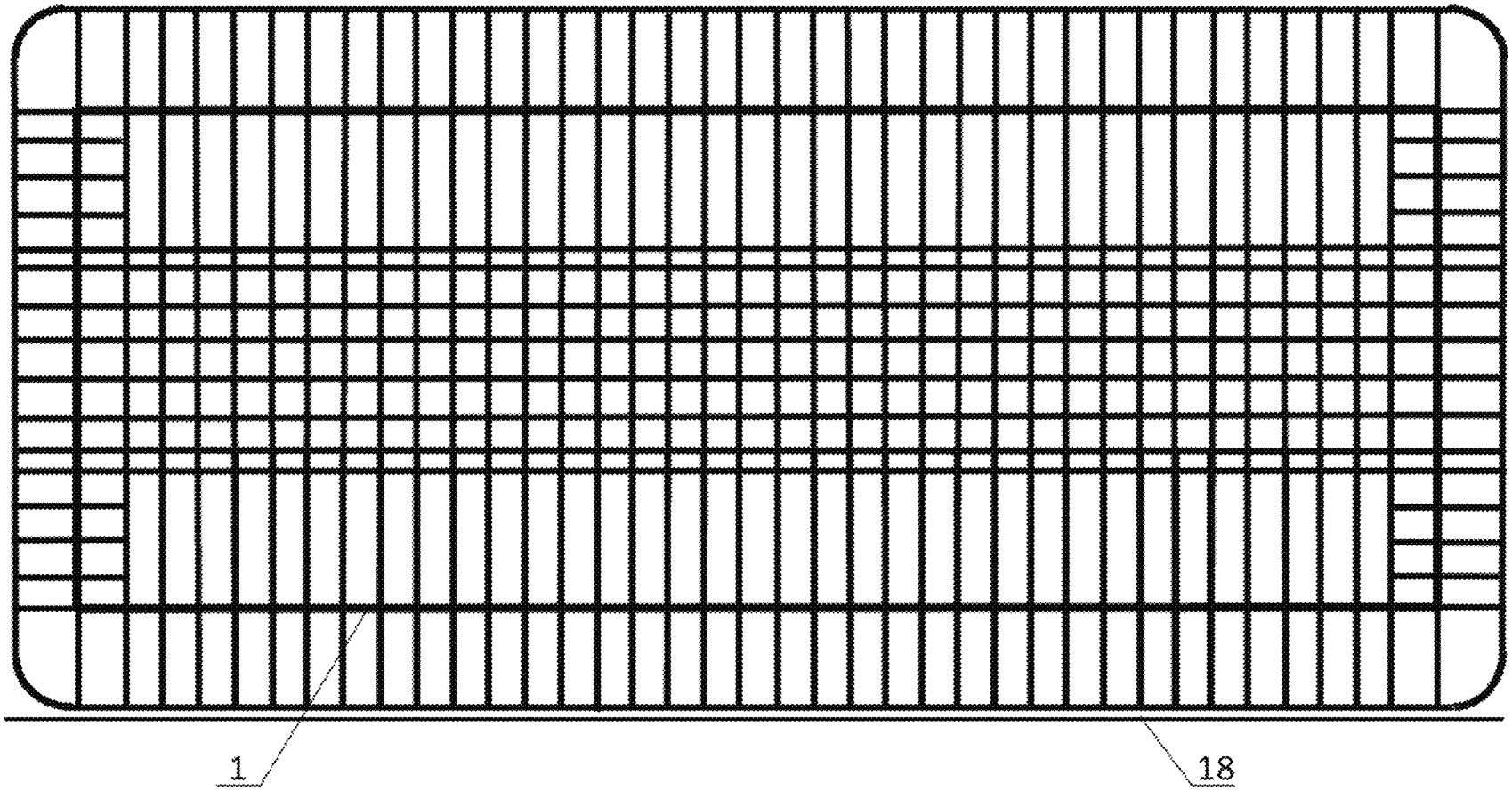

FIG. 7—vertical walls arrangement in section E-E for FIG. 2.

Figure 8:
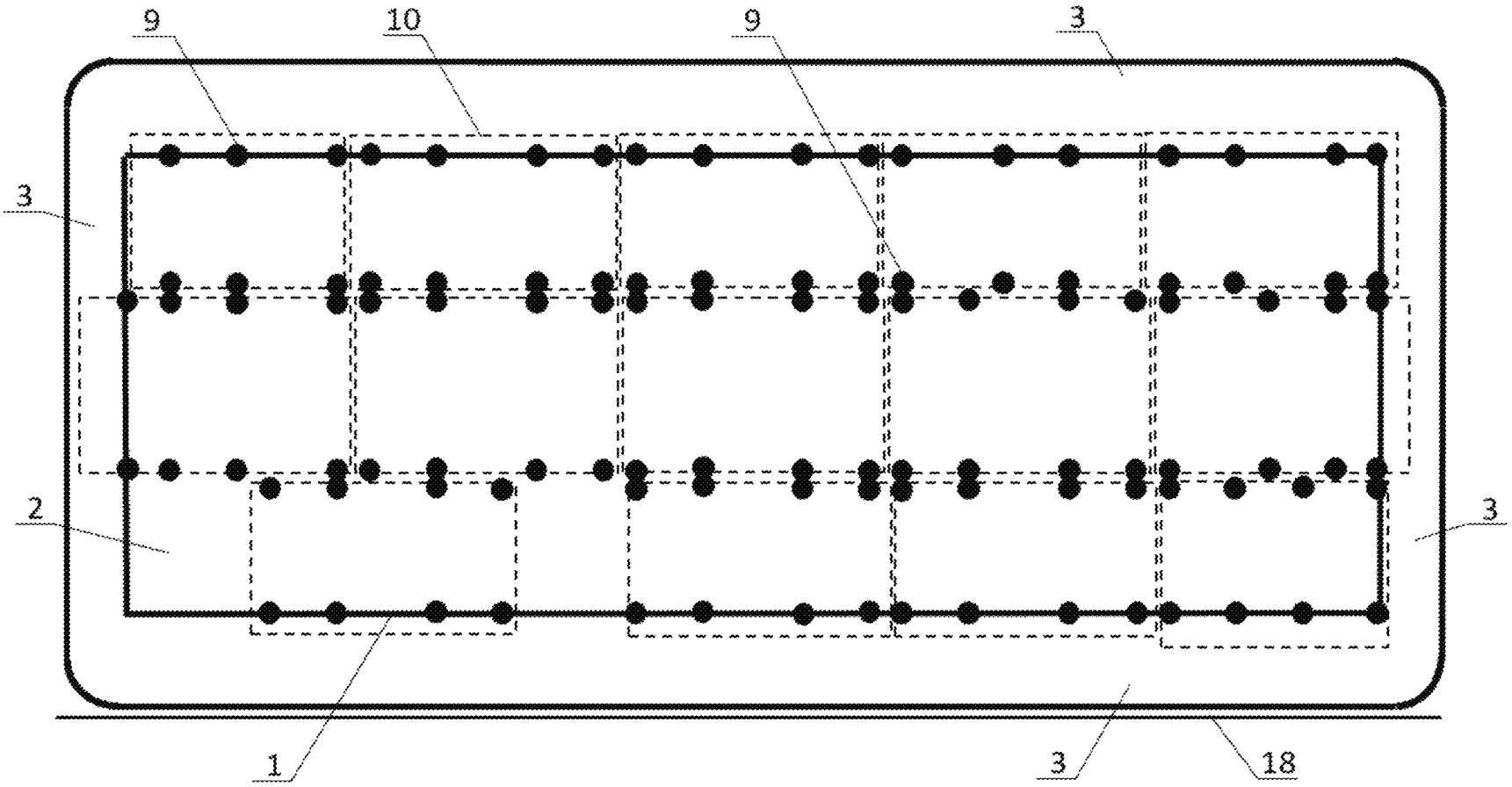

FIG. 8—layout of topside supports on the GBS top slab.

EXAMPLES OF THE INVENTION IMPLEMENTATION

The GBS is fabricated at a dedicated industrial site where topsides designed for production, transportation, transshipment, or storage as may be applicable depending on the intended use are installed onto the structure, to be then towed afloat to the installation site. The GBS is installed on a special underbase foundation on the seabed. To prevent scouring of the foundation under the GBS and the bottom of the water body, gabions or other similar devices may be placed on the bottom around the GBS. The GBS is installed near a dedicated quayside and is connected to a shore with overpasses and bridges, making it possible to lay communications to the shore without using underwater pipelines and/or extensive above-water overpasses, have easy access to the production complex and a possibility to swiftly evacuate personnel. Overpasses and bridges reaching the shore are installed after the GBS is installed at the operation site. Located near the shore line, the GBS is integrated with the onshore facilities, including hydrocarbons field being the source of feedstock for the production complex. Before the GBS is installed, the quayside may be used to deliver cargoes, for example, for development of the hydrocarbons field and construction of the onshore facilities.

The GBS is a three-dimensional structure made from reinforced concrete, which functions as a storage for extracted and processed feedstock, as well as for auxiliary substanses and materials. It underlies the topside of the production complex and is designed to be installed on seabed 25 of a water body with the help of its own weight. Central part 1 of the GBS is shaped as a rectangular prism and has top slab 2 (FIG. 1).

On the sides of central part 1 along the whole perimeter, GBS protruding part 3 with vertical outer walls is located. GBS central part 1 and protruding part 3 share the same base slab 4, and protruding part 3 is lower than GBS central part 1 (FIGS. 2 to 4).

GBS central part 1 is separated into compartments with vertical longitudinal and transverse walls 5 (FIGS. 5 to 7). Some compartments, e.g. compartments 6, are used to store the extracted and processed feedstock, while other compartments, e.g. compartments 7, are used to store ballast water. GBS protruding part 3 is separated with vertical walls 5 perpendicular to its outer walls into compartments, and compartments 8 located along the longer sides of the GBS are also included in the ballast system.

GBS top slab 2 has reinforced concrete stools 9 on which topside modules 10 are installed.

The GBS can stay afloat during water transportation to the site of the integrated production complex and can withstand ice impact in waters with ice conditions. Changing the GBS condition from floating to stationary at the site of installation on foundation 11 is ensured by flooding the ballast compartments 7, 8 and 20 with water.

The GBS outer dimensions may vary depending on the production complex purpose, e.g. for an LNG plant the GBS dimensions (including the protruding part 3) may be as follows: length 324 m, width 154 m, height 30.2 m. In this case the length of GBS central part 1 is 300 m, the width is 108 m, the height is 30.2 m. Protruding part 3 on the sides of the GBS has the width of 22 m, on the short-end walls of the GBS-12 m. The height of protruding part 3 is 13.75 m.

The main general arrangement solutions of the GBS structures are defined by technological parameters, as well as internal and external loads affecting the GBS structure, taking into account their maximum possible negative combination.

GBS central part 1 is rectangular prism-shaped and includes main bearing structures, i.e. vertical longitudinal and transversal walls 5 and horizontal slabs (top slab 2, base slab 4, and intermediate support slab 13 under main tanks 12 for storage of hydrocarbons and/or respective processed products). The bearing structures ensure required spatial stiffness of a frame of the GBS, including during transportation of the integrated production complex and it being afloat until it is installed. Reinforced concrete walls also provide partition the GBS into compartments in accordance with their functional purpose. Some of transverse walls 5 may have a rectangular opening in their central part instead of being solid. In this case they essentially serve the purpose of stiffening ribs.

Reinforced-concrete walls also serve as bearing structures that transfer the load from topside 10 to support slab 13 and foundation 11, that is why topside supports 9 are located above the intersections of the vertical longitudinal and transversal walls 5 of the GBS.

Top slab 2 of the GBS has slopes from the central longitudinal line to the edges for drainage of atmospheric precipitation and process spills. The structure of top slab 2 is designed to withstand explosion loads in case of emergency situations. In case cryogenic liquids are involved in the technological process, in order to protect top slab 2 from spillage of cryogenic media, steel with enhanced cold resistance characteristics is used as reinforcement.

Horizontal support slab 13 is provided between top and base slabs 2 and 4 to distribute the loads from the liquid hydrocarbons and/or respective processed products storage tank 12. Longitudinal and transverse walls 14 under this slab 13 transfer the load to base slab 4 and ensure the spatial stiffness of the structure.

Reinforced concrete based on modified normal density concrete with tensioned reinforcement is the main material of GBS central part 1.

Protruding part 3 is located along the perimeter of GBS central part 1, forming a single structure with it. Long sides of protruding part 3 mostly house ballast compartments 8 (FIG. 5), while the short-end sides mostly house auxiliary and engineering compartments 15. Protruding part 3 of the GBS serves the following main purposes:

- achieving the required target GBS buoyancy parameters;
- housing ballast compartments 8 mostly intended for GBS balancing, ensuring GBS being afloat with an even keel, without roll and trim;
- forming a natural protective barrier in case of design emergency collision/ship impact; protruding part 3 will absorb and dissipate most of the collision energy, preventing damage to the main part of the GBS frame ensuring the integrity and preservation of main tanks 12 and the bearing structures of the topside foundation;
- housing auxiliary process and marine equipment ensuring LNG carriers mooring and offloading of liquid hydrocarbons.

Storage tanks for liquid hydrocarbons and/or respective processed products are accommodated in the GBS compartments and intended for storage of products of the integrated production complex. Depending on its intended use, the production complex may also have storage tanks for feedstock, semi-processed products, and consumables. GBS central part 1 has a number of tanks 12 (FIG. 5) that may have different design depending on the properties of substances to be stored. For unpressurized storage of LNG and cryogenic liquids, membrane tanks are used. In this case, tank 12 consisting of a metal membrane made of stainless steel or invar (Fe—Ni alloy) separated from concrete structure by a thermal insulation layer is installed inside concrete compartment 6. The thermal insulation layer is located directly on top slab 2, intermediate slab 13 and GBS walls, transferring the loads from tank 12 and its liquid content to the above-mentioned boundary structures. The GBS slabs and walls thus serve as support structures for membrane tanks, with which they are integrated into a single structural unit. To prevent any leaks, the bottom and the side surfaces of membrane tanks 12 have a secondary barrier being an additional membrane installed inside the insulation layer.

In case of an LNG plant, liquefied gas is stored in two 115,000-cbm tanks 12, each installed in a 135×40×24 m individual compartment 6. Compartments 6 with tanks 12 are surrounded by dry compartments 16 enabling inspections of external surfaces of the tanks boundary structures.

For storage of condensate and other liquid hydrocarbons that do not require low temperatures, GBS concrete compartments 17 may be used, with their boundary structures serving as a protective barrier. Some of compartments 7 can be used both for ballast water and for storage of condensate and other liquid hydrocarbons that do not require maintaining low temperatures. In case of an LNG plant, there is a 75,000-cbm 135×30×30 m compartment 7 for stable condensate storage and one of compartments 17 for substandart condensate storage with a capacity of 5,000 cbm and 30×8×30 m in size.

"Wet" storage involving an underlying water layer may be used for hydrocarbons that are less dense than water. In this case, the bottom layer of the stored product around 1 m in thickness is considered a commingling area ensuring guaranteed separation of water and the stored product during loading operations. Compartment 7 is also slightly pressurized (from the atmospheric pressure level) using a nitrogen blanket in the upper part of compartment 7 to prevent air penetration to compartment 7 and prevent any flammable and explosive gas mixtures with hydrocarbon vapors from forming.

The height of the underlying water layer in compartment 7 may be fixed or variable. In case of the former, the height of the underlying water layer is fixed, e.g. at two meters, irrespective of the quantity of condensate or other liquid hydrocarbons stored in the compartment. The change of the condensate volume in compartment 7 is compensated by the change of the volume of the nitrogen blanket. In the latter case, the height of the underlying water layer changes for compartment 7 to be permanently filled with liquid. As compartment 7 is filled with condensate or other liquid hydrocarbons, part of water is removed from it with active ballast system. When the level of hydrocarbons stored decreases, additional water is fed to compartment 7.

Compartments 6 for storage of large volumes of hydrocarbons are located in GBS central part 1. Smaller compartments as tanks (for example, for diesel fuel, hot oil or glycol solution) could also be located in protruding part 3 of GBS.

To store small volumes, self-supported tanks are also used in GBS compartments (in central part 1 or in protruding part 3). In case of LNG plant, self-supported tanks are used for waste water, demineralized water, fresh water, wash water, absorber, butane and propane.

Auxiliary and engineering compartments 16 in GBS central part 1 are located to the sides of main hydrocarbon storage compartments 6 and in the center between them. These compartments 16 are intended for process needs, placement of equipment, tanks of process fluids, as well as access and evacuation routes for personnel. With dry compartments 16 along the perimeter of main compartments 6 for hydrocarbons storage, external surfaces of the boundary walls of tanks 12 for hydrocarbons storage can be inspected.

Auxiliary and engineering 15 are located in protruding part 3 of the GBS. These compartments 15 are intended for process needs, placement of equipment and tanks of process fluids.

Supports 9 of topside 10 on top slab 2 of the GBS ensure perception of support reactions on the main load-bearing structures of the GBS from topside 10. Structurally, supports are reinforced-concrete pylons with heads for embedded components. Special sealings are used at the GBS supports 9 and topside 10 connection points to ensure free rotation and movement in predetermined directions to compensate for thermal expansion of the topside 10.

Location of supports 9 on the layout (FIG. 8) is defined based on the crossing of the GBS load-bearing walls 5 to ensure distribution of loads from topside 10. Deck 24 supporting topside 10 is installed on supports 9.

The GBS ballast system includes internal ballast compartments 7, internal ballast compartments 20 under the support slab 13, formed by vertical walls 14, as well as external ballast compartments 8 located in GBS central part 1 and in GBS protruding part 3. A ballast recirculation and heating system is provided to prevent freezing of water in the ballast compartments. The water in the ballast compartments is heated using waste heat from exhaust gas of gas turbines installed on the topside 10.

The ballast system performs two main functions:

ballasting, i.e. changing the weight of GBS, ensuring the required GBS draft when afloat and the structure stability once the GBS is installed on the underbase foundation;

GBS balancing, i.e. bringing GBS on an even keel, without roll and trim when afloat, through compensation with ballast water for the structure centre of gravity deviation from its geometric center.

Liquid hydrocarbon offloading jetty 21 is structurally integrated with the GBS and the topside. Fenders and an offloading platform with loading arms as well as other marine and process equipment enabling liquid hydrocarbon offloading are installed on protruding part 3 on the seaward side of the GBS. Mooring equipment for carrier berthing is installed on the topside seaward side.

Jetty 21 can also be used to discharge liquid hydrocarbons from a carrier. If the production complex on a GBS is a power generation facility, the jetty main function is to receive LNG from gas carriers.

The layout of compartments inside the GBS depends on its functional design, including the intended use of the integrated production complex. In general, the GBS is designed to have three types of compartments-ballast compartments, hydrocarbon storage compartments, auxiliary and engineering compartments.

In case of a GBS LNG plant, GBS central part 1 comprises six main compartments (FIG. 5). Two compartments 6 along the GBS centerline are intended for hydrocarbon storage, four side compartments 7 can be used both as ballast compartments and additional storage compartments for hydrocarbons, e.g. condensate. In case of "wet" storage of hydrocarbons with variable water level, compartments 7 are both ballast compartments and storage compartments for hydrocarbons and/or respective processed products. Auxiliary and engineering compartments 16 as well as additional hydrocarbon storage compartments 17 are located between main compartments 6, 7.

Additional ballast compartments 20 (FIGS. 2 and 4) are located under main hydrocarbon storage compartments 6 between base slab 4 and support slab 13 for main hydrocarbon storage tanks 6, 7.

Protruding part 3 (FIG. 5) accommodates ballast compartments 8 and auxiliary and engineering compartments 15. In case of GBS LNG plant, protruding part 3 on the sides comprises mostly ballast compartments 8 while on the short ends it comprises mostly auxiliary and engineering compartments 15.

Compartments may be separated by transverse partitions, except for main LNG storage compartments 6. In this case, openings are made inside the ballast compartments for ballast water to flow through, and passages for personnel and penetrations for cabling and piping are made in partitions of the auxiliary and engineering compartments.

The integrated GBS is connected to the shore by two overpasses 22, in which piping and cabling are laid, as well as three evacuation bridges 23 for personnel movement and evacuation, when needed. The overpasses and bridges are made of steel and mounted on supports. The supports are erected on GBS top slab 2 on one end, and on quayside 18 on the other. Seabed 25 and water level 26 in the body of water are shown on FIGS. 2 to 4.

The invention claimed is:

1. A gravity-based structure comprising a central part and a protruding part, with the central part being a rectangular parallelepiped with a top slab and an intermediate support slab, and the protruding part stretching along central part sides all around a perimeter of the top slab and having external vertical walls and internal vertical walls forming first compartments, and the protruding part and the central part share a rectangular base slab, with the protruding part being lower in height than the central part, the central part has internal vertical longitudinal and transverse walls forming second compartments located on the intermediate support slab and third compartments located on both sides of the intermediate support slab and extending from the base slab to the top slab, and there are additional longitudinal and transverse walls between the intermediate support slab and the base slab forming fourth compartments, wherein the first compartments are located at protruding part sides, and some of the third compartments, and the fourth compartments are ballast compartments.

* * * * *